United States Patent [19]

Schijf

[11] Patent Number: 4,644,725

[45] Date of Patent: Feb. 24, 1987

[54] DOUBLE-WALLED PANEL

[75] Inventor: Hendrikus J. Schijf, St Amandsberg, Belgium

[73] Assignee: Contractual Services (Jersey) Ltd., Jersey, Channel Islands

[21] Appl. No.: 710,241

[22] Filed: Mar. 11, 1985

[30] Foreign Application Priority Data

Mar. 10, 1984 [GB] United Kingdom ..... 8406352

[51] Int. Cl.[4] ..... E04C 1/10

[52] U.S. Cl. ..... 52/463; 160/232; 52/465; 52/588

[58] Field of Search ..... 52/588, 463–466; 160/187, 201, 229 R, 232, 235, 236

[56] References Cited

U.S. PATENT DOCUMENTS 2,880,796 4/1959 Stroup ..... 160/232
3,247,637 4/1966 Robertson ..... 160/201
3,359,594 12/1967 Pastoor ..... 160/235

FOREIGN PATENT DOCUMENTS 236093 2/1964 Austria ..... 160/232
629683 7/1963 Belgium ..... 160/232

*Primary Examiner*—James L. Ridgill, Jr.
*Attorney, Agent, or Firm*—Pollock, Vande Sande & Priddy

[57] ABSTRACT

A double walled panel (1) comprising on its small longitudinal sides (*2a, 2b*) a profiling formed in cross-section by a curved nose (7) which faces a wide side surface (10) the base of which is located at a distance from the same wide side surface (10). A free-standing thickened portion (6) is disposed at the other small side (*2a*) and supported near the same wide side surface (10) fitting into an adjacent panel recess (5) enclosed by its curved nose (7).

13 Claims, 17 Drawing Figures

DOUBLE-WALLED PANEL

BACKGROUND OF THE INVENTION

This invention relates to a double-walled panel comprising, on its small longitudinal sides, a profiling formed from recesses and frames, the profiling on one small longitudinal side being formed so as functionally to complement the profiling on the other small longitudinal side so that two adjacent panels can be interengaged.

A panel of this kind is disclosed in Luxembourg Patent Specification 68,822. It is described therein that adjacent panels can interengage by their profiling and pivot over a restricted angle with respect to one another in order to provide a closure for the internal freight area of trucks. The panels are small in relation to their thickness, so that they are usable only within restricted dimensions.

SUMMARY OF THE INVENTION

It is an object of the present invention to provide a double-walled panel which is very wide in relation to its thickness, and by means of which it is possible to interconnect very long panels so that they can be used, for example, as wall lining or panelling in order to embellish or insulate a given wall. Panels of this kind can also be used to close garage doors or entrances to workshops, because special attention is paid to the strength of the connection between the panels. Obviously panel deflection must be taken into account, for example, if the said panels are exposed to strong wind pressure.

According to the invention, this is made possible with a double-walled panel which has on one small side a frame which, in cross-section, forms a curved nose which faces one wide side surface, the base of which is located at a distance from the same wide side surface. The end of the nose encloses a recess located at said side surface, a free-standing thickening (as seen in cross-section) being disposed at the other small side and supported near the same wide side surface of the panel, fitting into an adjacent panel recess enclosed by the curved nose.

The special construction of the curved nose with the thickening fitting therein enables the panels to be hooked into one another so that they can readily be fitted as a wall lining. According to the invention, the curved nose is of hollow construction and internally provided with reinforcing partitions, while the free-standing thickening is supported on a parallel frame which is, however, spaced from the wide side surface and which for this purpose comprises a support frame which runs back from said wide side surface to the other frame at the thickening. This provides a very sturdy hinge connection, and the panel is also suitable for wide entrance doors, such as for garages having, for example, a width of 4.5 to 5 m. The panel can in such cases be readily extruded, for example, from plastic.

According to the invention, a further reinforcement is obtained if extra frames are provided at the two small side walls at a distance from the curved nose and from the free-standing thickening, respectively, and in cross-section having the shape of a hollow nose enclosing a recess between said nose and the back of the curved nose and the upright frame with the thickening, respectively.

Extra reinforcement can further be realized if the hollow nose has, at a distance from the free-standing thickening, a widened and curved end face facing said thickening, the curvature thereof being adapted to the curvature of the back of the curved nose. If the panels are then hooked into one another, e.g., to form a door, the curved nose is additionally supported, so that the panels can be exposed to strong wind pressure.

According to the invention, further reinforcement of the co-planar panels can be obtained if the hollow nose having the widened curved end face comprises at its side remote from the free-standing thickening, a portion which is set back with respect to the adjacent wide side of the panel, against which setback portion the hollow nose can bear at the small side wall at the curved nose.

As described hereinbefore, the panel can readily be made from plastic by extrusion, while in addition the panel itself may have considerable resistance to deflection by the provision of partitions extending longitudinally to the panel between the wide side walls thereof. At the small side walls, extra reinforcing partitions may be provided between the wide side walls and at an angle with respect to the partitions.

The open ends of the panels can subsequently be closed by a cover strip so constructed that a cap adapted to the top end faces of the panel can engage around the wide side surfaces thereof, said cap comprising at one end a pin which fits into the free-standing thickening and which at the other side has a recess which engages with clearance around the pin.

BRIEF DESCRIPTION OF THE DRAWINGS

The invention will now be explained in detail with reference to the accompanying drawings, wherein.

DESCRIPTION OF THE PREFERRED EMBODIMENTS

Figure 1:
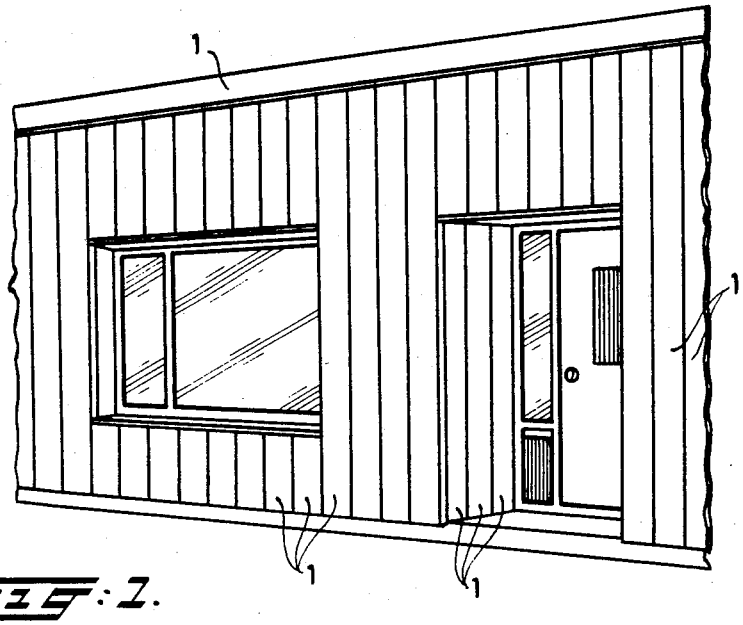
FIG. 1 is a perspective view of part of a wall lining with panels according to the invention.
Figure 2:
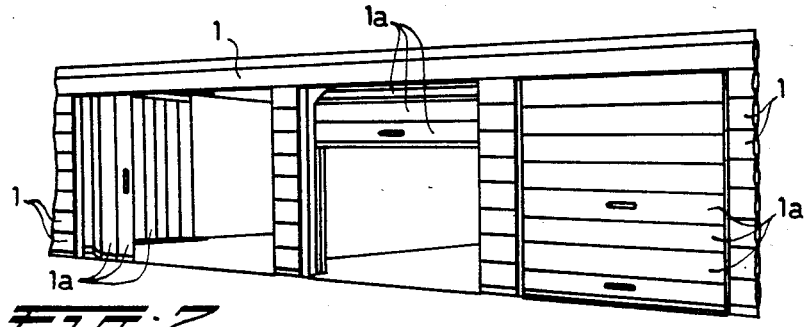
FIG. 2 is a perspective view of a garage provided with closure means obtained by means of panels according to the invention.

A double-walled panel can be used for wall lining, e.g. to embellish a wall or for thermal insulation, the lining being made of long or short panels 1, as shown in FIGS. 1 and 2. A double-walled panel can also be used for doors, e.g., for garages or to close the entrances to halls; the double-walled panels used for this purpose are denoted to reference 1*a*.

Figure 3:
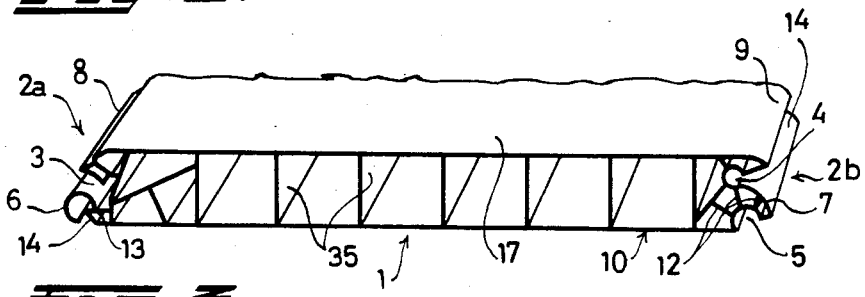
FIG. 3 is a perspective end elevation of part of a double-walled panel according to the invention.
Figure 4:
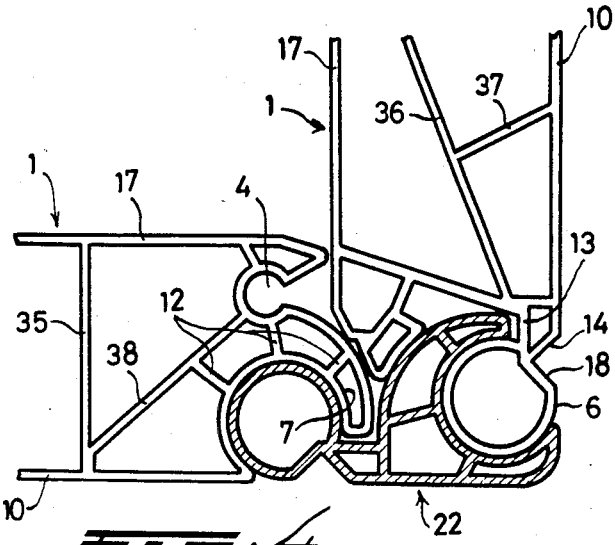
FIG. 4 is a cross-section through an auxiliary profile used with a panel according to the invention to form a corner structure, the panel being used as wall lining.
Figure 5:
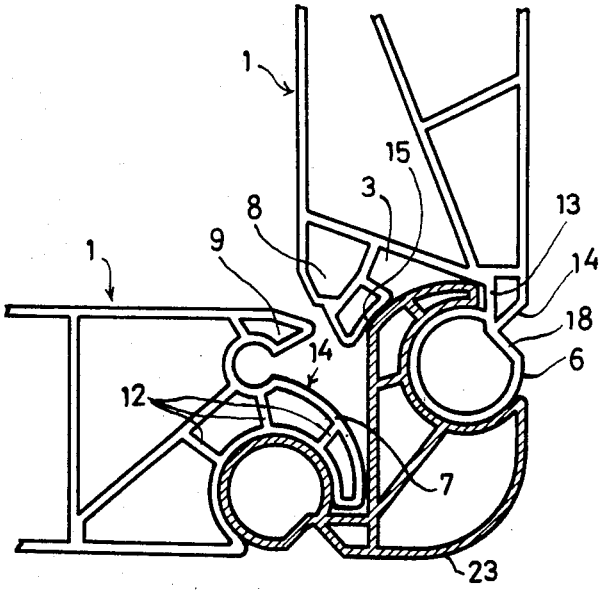
FIG. 5 is a modified structural view of a corner profile according to FIG. 1.
Figure 7:
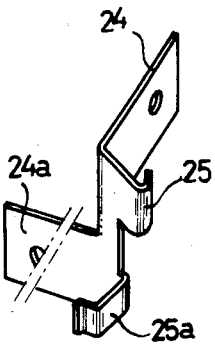
FIG. 7 is a perspective view of a fixing means at a corner of a panelled wall lining made from panels according to the present invention.

This can be effected by employing a double-walled panel 1 (FIG. 3). At the small longitudinal sides 2*a* and 2*b* the panel comprises a profiling formed from recesses 3, 4, 5 and frames 6, 7, 8 and 9, the profiling at one small longitudinal side being shaped for functionally complementing the profiling at the other small longitudinal side so that two adjacent panels can be interengaged. According to the invention, the panel is so constructed at to have a frame 7 at one small side 2*b*, the said frame forming in cross-section a curved nose facing a wide side surface 10 (see also FIGS. 4, 5 and 7), the base thereof being situated at a distance from the same wide side surface 10 and the free end of the nose enclosing a recess 5 at said side surface. At the other small side 2*a* there is provided—as seen in cross-section—a free-standing thickening (frame 6), which is supported near the same wide side surface 10 of the panel and fits into a recess 5 of an adjacent panel, said recess being enclosed by a curved nose. As will be clear from FIGS. 3, 4, 5 and 8, the curved nose 7 is of a hollow construction and is provided with internal reinforcing partitions 12. The freely supported thickening 6 is supported on a parallel frame 13 which is, however, spaced from the wide side surface 10 and which for this purpose has a support frame 14 which runs back from said wide side surface 10 to the other frame 13 at the thickening 6. Extra frames 8 and 9 respectively are mounted at the two small side walls 2*a* and 2*b*, being spaced respectively from the curved nose 7 and the free-standing thickening 6, said extra frames having—as seen in cross-section—the form of hollow noses, enclosing a recess 4, 3 respectively between the said noses 9, 8 and the back 14 of the curved nose and the upright frame 13 with the thickening 6, respectively. Spaced from the free-standing thickening 6 the hollow nose 8 has a widened and curved end face 15 facing said thickening, the curvature of end face 15 being adapted to the curvature of the back 14 of the curved nose 7. The hollow nose 8 with the widened curved end face 15 is internally provided with a reinforcing partition 16. The hollow nose 8 with its widened curved end face 15 also comprises, on the side remote from the free-standing thickening 6, a portion which is set back with respect to the adjacent wide side 17 of the panel, against which set-back portion the hollow nose 9 can bear at the small side wall 2*b* at the curved nose 7.

These features provide a good rigid connection against lateral pressure on the panel, e.g., wind pressure, such as may often occur, particularly with doors of larger dimensions.

To make the double-walled panel suitable as a panel 1*a* for doors, the panels being required to be pivotable at their connection, the upright thickening 6 has a round cross-section with a flattened portion 18 near the support frame 14 running back from the wide side surface 10. Preferably, the flattened portion 18 and the part of the frame which runs back are at a right angle to one another. In this way, the panels 1 and 1*a* do not have to be slid into one another in their longitudinal direction, but can easily be hooked into another at an angle outside the operational angle, as shown in FIG. 10 by the broken lines 19, and also be pivoted into the operating position.

Figure 6:
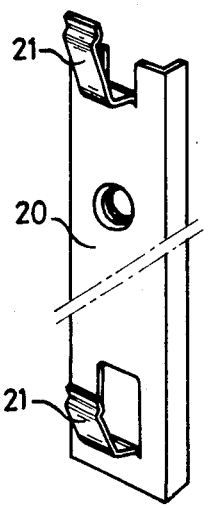
FIG. 6 is a perspective view of part of a mounting frame for securing the panels for wall lining.

Metal support frames 20 provided with stamped-out lips 21 (FIG. 6) can be used in these conditions for mounting the wall lining panels.

Figure 10:
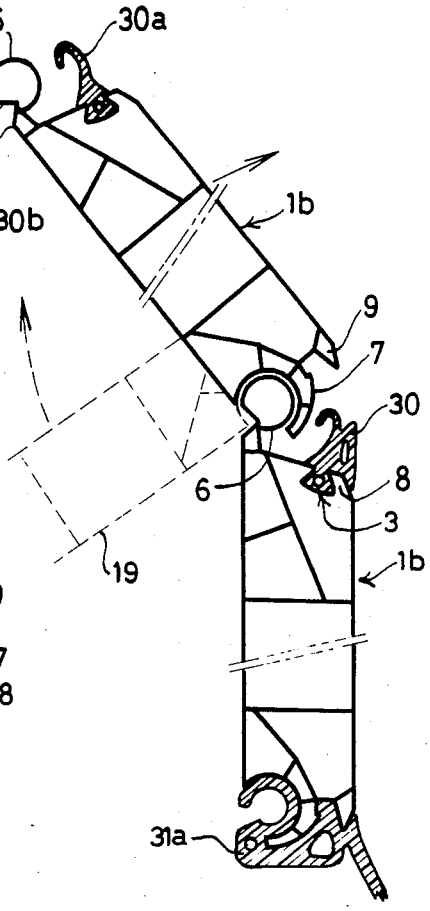
FIG. 10 is a view similar to FIG. 9 showing how the panels can be hooked into one another.

The support frames 20 are screwed against one another at certain distances—vertically for horizontal panels and horizontally for vertical panels—whereupon the panels can hook by their noses 9 behind the lips 21 during the pivoting of the panels which have just been hooked in, (FIG. 10). When special corner frames 22 or 23 are used, separate anchoring means can be used (FIG. 7), in which a hook 25 is disposed on a limb 24 adapted to be screwed against a wall, said hook being adapted to hook behind a nose 9, while a hook 25*a* adapted to hook behind a nose 8 is disposed on the limb 24*a*.

Figure 11:
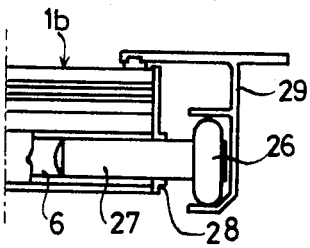
FIG. 11 is a top plan view of a guide roller mounted in the ends of the panels, of the kind used for vertical lift-up doors on both sides thereof.
Figure 12:
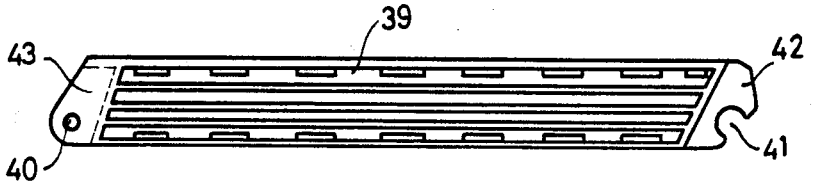
FIG. 12 is a front elevation of a cover strip used with a double-walled pin panel according to the invention.
Figure 13:
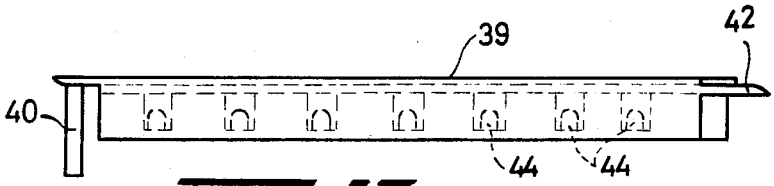
FIG. 13 is a side elevation of the frame of FIG. 12.

For use as a door, it is possible to employ a guide roller 26 rotatable on a spindle 27, the spindle being adapted to be fitted into the hollow thickening 6 (FIG. 11). By means of a clamping ring 28 the roller 26 can then be fixed in a position in which it runs in a guide rail 29. The latter can be screwed against the periphery of a door opening, bent to a given curvature at the top end, and mounted along the ceiling or a support used for this purpose. This principle of guide rollers in rails 29 is known per se and requires no further description.

Figure 9:
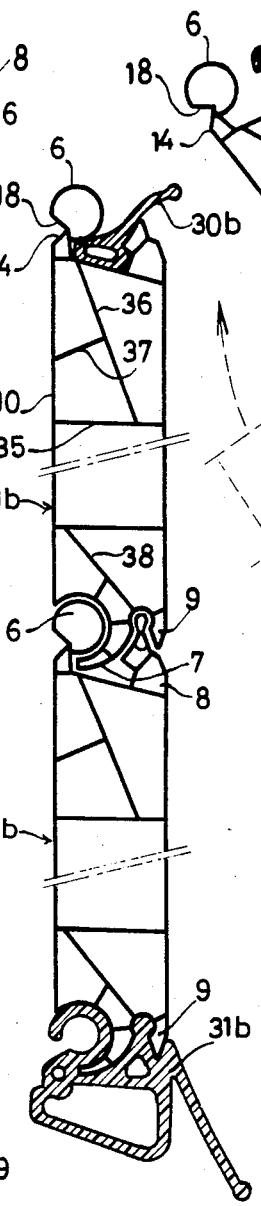
FIG. 9 is a diagram showing two inter-hooked double-walled panels provided with auxiliary sealing frames in case the panel according to the invention is used for a vertically swing-up garage door, part of the door being passable along the grage ceiling.

For special applications it may be desirable to fit an insert 30 into the recess 3 between the nose 8 and the upright thickening 6, with which insert a nose 9 on the small side wall 2*b* at the curved nose 7 can co-operate (FIG. 10). In that case the insert is made of elastic material. A similar insert 30*a* or 30*b* (FIG. 9) can be utilized to provide a seal at the top of a door. An elastic sill profile 31*a* or 31*b* can be employed at the bottom of the door. As will be seen from FIGS. 9 and 10, there may be small modifications in the construction of the panel near the small sides.

Figure 16:
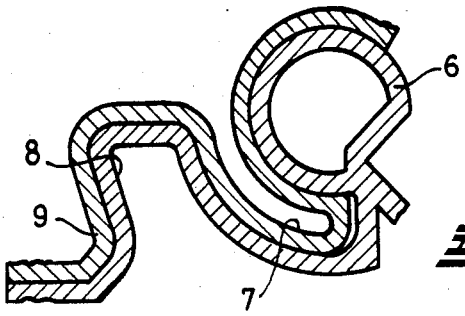
FIG. 16 is a modification of the profiling of inter-engaging portions of two panels.
Figure 17:
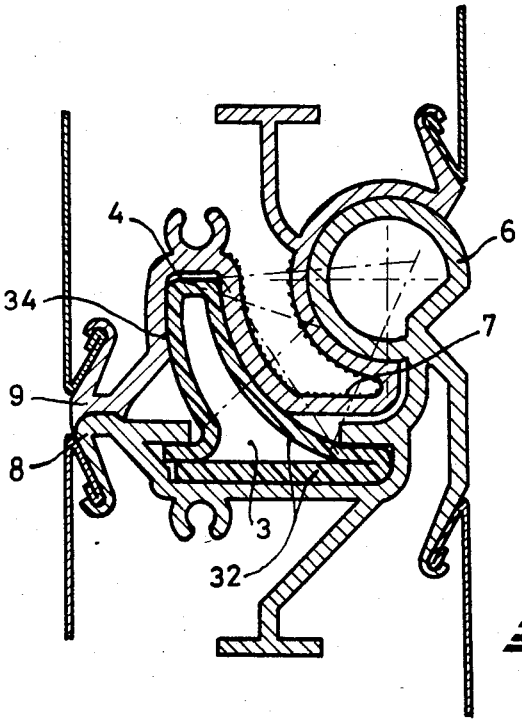
FIG. 17 is another modification of inter-engaging panels provided with a reinforcing frame.

A similar modification is shown in FIG. 16, in which the recess between the nose 8 and the thickened portion 6 is adapted to receive only the curved nose 7. The nose 8 then fits into the recess between the nose 9 and the curved nose 7. Another embodiment is shown in FIG. 17, in which a metal insert 32 is provided in the recess 3 between the nose 8 and the thickening 6, part of said metal insert 32 fitting into the recess 4 between the nose 9 and the curved nose 7. This metal insert contributes to rigidifying the connection between the two panels. The metal insert 32 has, at least on the side remote from the thickening, a curved side surface 33 which co-operates with a curved side surface 34 of the nose 9 on the small side wall at the curved nose 7.

Figure 8:
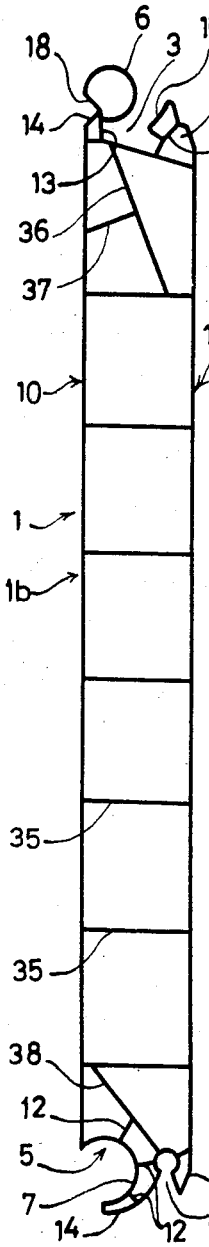
FIG. 8 is a diagram of the double-walled panel of FIG. 3 showing the compartmentalization of the panel.

As can be seen most clearly from FIGS. 3 and 8, partitions 35 extending in the longitudinal direction of the panel, are provided between the wide side walls 10 and 17 thereof; they can readily be co-extruded in an extrusion process in case, for example, the panel is made entirely of plastic. These partitions contribute considerably to giving the entire panel good rigidity. Extra reinforcing partitions 36, 37 and 38 are provided at the small side walls between the wide side walls and are at an angle with respect to the partitions 35 (FIG. 8). This gives good reinforcement of the support for the thickening 6 and the nose 7.

Figure 14:
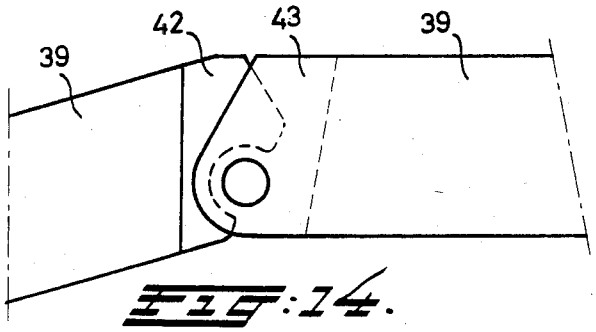
FIG. 14 is a diagram showing how two cover strips of adjacent panels can inter-engage.
Figure 15:
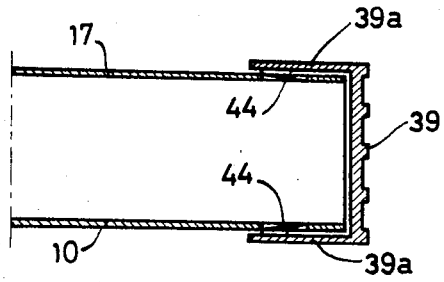
FIG. 15 is a cross-section of the cover strip of FIGS. 12 and 13.

According to the invention, a cover frame for the open ends can be used in the double-walled panel. FIGS. 12 to 15 show a cover frame of this kind. A cap 39 fitted to the top end faces of the panel can engage around the wide side surfaces 10 and 17 of the panel. At one end the cap bears a pin 40 which fits into the free-standing thickening 6 and at the other side the cap 39 has a recess 41 which engages with clearance around the pin 40 (FIG. 14). The free lip 42 in which the recess 41 is formed is set back with respect to the lip 43 bearing the pin 40. Those parts 39*a* of the cap 39 which engage around the wide sides 10 and 17 of the panel are provided, at their sides facing one another, with lugs 44 which fit into holes to be formed in the side walls of the panel (FIG. 15).

What is claimed is:

1. A double-walled panel adapted to be interconnected with a similar, adjacent panel, each of said panels having a first pair of longitudinally extending opposed sides and a second pair of longitudinally extending, relatively narrow opposed sides, each of said narrow longitudinal sides comprising a profiling formed of recesses and frames, the profiling on a first of said narrow longitudinal sides being formed so as to functionally complement the profiling on the second of said narrow longitudinal sides, whereby two adjacent panels can be interengaged, said panel having on one narrow side a frame (7) which, in cross-section, forms a curved nose facing towards one of the wide side surfaces, a base of said nose being spaced from said one wider side surface (10), and a free end of said nose enclosing a recess (5) located at said one wider side surface, said panel further having a free-standing thickened portion (6) disposed at the other narrow side and supported near said one wider side surface of said panel, said thickened portion being adapted to fit into said recess enclosed by said curved nose defined in an adjacent panel, said thickened portion being supported on a frame (13) which is parallel to but spaced from said one wider side surface and which has a support frame (14) extending from said one wider surface to said parallel frame (13) at said thickened portion (6), and the latter has a round cross-section with a flattened portion (18) near said support frame.

2. A double-walled panel according to claim 1, wherein said flattened portion (18) of said thickened portion (6) and said support frame (13) extend at right angles to one another.

3. A double-walled panel according to claim 1, wherein said curved nose is of hollow construction and internally provided with reinforcing partitions (12).

4. A double-walled panel according to claim 1, comprising partitions between the wider side walls of said panel in the longitudinal direction thereof and additional reinforcing partitions at the narrow sides between said wider side walls and extending at an angle with respect to said longitudinal partitions.

5. A double-walled panel according to claim 1, comprising additional frames (8, 9) at the two narrow sides spaced respectively from said curved nose (7) and from said thickened portion (6), said additional frames, in cross-section, having the shape of a hollow nose (8), enclosing a recess (3, 4) between the latter and the back of said curved nose, and said frame with said thickened portion, respectively.

6. A double-walled panel according to claim 5, wherein said hollow nose (8) has a widened and curved end face (15) spaced from but facing said thickened portion, the curvature of said end face being adapted to the curvature of the back of said curved nose (7).

7. A double-walled panel according to claim 5, wherein said hollow nose (8) associated with said thickened portion has, at the side remote from the latter, a portion which is set back with respect to the other (17) of the wider sides of said panel, against which set-back can bear the hollow nose (9) at said one narrow side of an adjacent panel.

8. A double-walled panel according to claim 5 or 6, wherein the hollow nose associated with the thickening is internally provided with a reinforcing partition.

9. a double-walled panel according to any one of claims 5 to 7, comprising an insert fitted into the recess between said hollow nose and said thickened portion, for co-operation with said hollow nose on said one narrow side of an adjacent panel.

10. A double-walled panel according to claim 9, wherein said insert is made from elastic material.

11. A double-walled panel according to claim 9, wherein said insert is made of metal and is provided, at least on the side remote from said thickened portion, with a curved side surface co-operating with a curved side surface of said hollow nose on said one narrow side of an adjacent panel.

12. A cover strip for use with a double-walled panel according to any of claims 1 to 4, the strip comprising a cap which is adapted to fit the narrow sides of the panel and can engage around the wider side walls thereof, the cap at one end comprising a pin which is arranged to fit into the free-standing thickening, and at the other side a recess whereby to engage with clearance around the pin on a strip of an adjacent panel.

13. A cover strip according to claim 12, wherein at the locations engaging around the wider side walls of the panel are provided lugs which fit into apertures formed in the wider sides walls of the panel.

* * * * *